United States Patent [19]

Bechtold

[11] Patent Number: 4,999,937

[45] Date of Patent: Mar. 19, 1991

[54] PANEL SIGN HAVING RATCHET HINGE MEANS

[76] Inventor: Joseph Bechtold, 1046 Lighthouse Dr., Schaumburg, Ill. 60193

[21] Appl. No.: 435,584

[22] Filed: Nov. 13, 1989

[51] Int. Cl.[5] ..... G09F 15/00

[52] U.S. Cl. ..... 40/610; 40/612; 16/329

[58] Field of Search ..... 40/606, 610, 612; 404/6; 116/63 P; 16/326, 327, 328, 329, 330, 331, 332, 351; 240/354.6, 359.7; 211/170, 171; 248/463, 457, 291

[56] References Cited

U.S. PATENT DOCUMENTS

| | | | |
|---|---|---|---|
| 1,590,562 | 6/1926 | Blonigen | 248/291 |
| 3,256,853 | 6/1966 | Underwood | 116/63 P |
| 3,507,245 | 4/1970 | Grabow | 116/63 P |
| 4,183,695 | 1/1930 | Wilcox | 40/606 |
| 4,248,001 | 2/1981 | Feuvray | 40/606 |
| 4,253,260 | 3/1981 | Maza et al. | 40/610 |
| 4,624,210 | 11/1986 | Glass | 116/63 P |
| 4,792,258 | 12/1988 | Goff | 40/610 |
| 4,796,369 | 1/1989 | Hamann | 40/606 |
| 4,854,063 | 8/1989 | Brunell | 40/606 |
| 4,859,983 | 8/1989 | Kulp et al. | 116/63 P |
| 4,875,302 | 10/1989 | Noffsinger | 40/606 |

FOREIGN PATENT DOCUMENTS

| | | | |
|---|---|---|---|
| 456448 | 11/1928 | Fed. Rep. of Germany | 16/329 |

*Primary Examiner*—Kenneth J. Dorner
*Assistant Examiner*—James M. Gardner
*Attorney, Agent, or Firm*—Douglas B. White

[57] ABSTRACT

There is provided a floor sign having a ratchet positionable hinge and replaceable signage. The hinge operates by frictionally engaging one side of the hinge integral with one panel and engaging the opposite side of the hinge, which is integral with the other panel, by means of a ratchet mechanism. This mechanism is arranged to be slideably disengaged by shifting the axial member of the hinge. Selected signage is attachable by magnetic adhesive, or hook/loop (Velcro) methods.

6 Claims, 2 Drawing Sheets

PANEL SIGN HAVING RATCHET HINGE MEANS

BACKGROUND OF THE INVENTION

1. Field of the Invention

This invention relates generally to free-standing floor signs used to indicate warnings, and particularly to methods to improve their usefulness and their economy.

2. Description of the Prior Art

Existing floor signs are typically of plastic construction with signage indicia printed or permanently adhered to paired panels hinged at one end to open to a free-standing triangular shape. In one example, U.S. Pat. No. 4,796,369, a protruding sign extension is shown to attach to the hinge and project the sign upwardly.

Other innovations in these signs have been directed to the hinge mechanism. In U.S. Pat. No. 4,253,260 a hinge is presented which hook the panels together by passing an extending portion of one panel into a slot on the other panel. In U.S. Pat. No. 4,624,210 the hinge utilizes detents to lock the barricade into an open position. In U.S. Pat. No. 4,298,186 an engageable hinge is shown which accepts an axial pin member, and the hinge sections are formed as hook-like projections to limit motion.

SUMMARY OF THE INVENTION

The present invention provides a floor sign having a ratchet positionable hinge and replaceable signage. The hinge operates by frictionally engaging one side of the hinge integral with one panel and engaging the other side of the hinge, which is integral with the other panel, by means of a ratchet mechanism. This mechanism is arranged to be slideably disengaged by shifting the axial member of the hinge. Signage is attachable by magnetic, adhesive, or hook/loop (Velcro) attachment means.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 1:
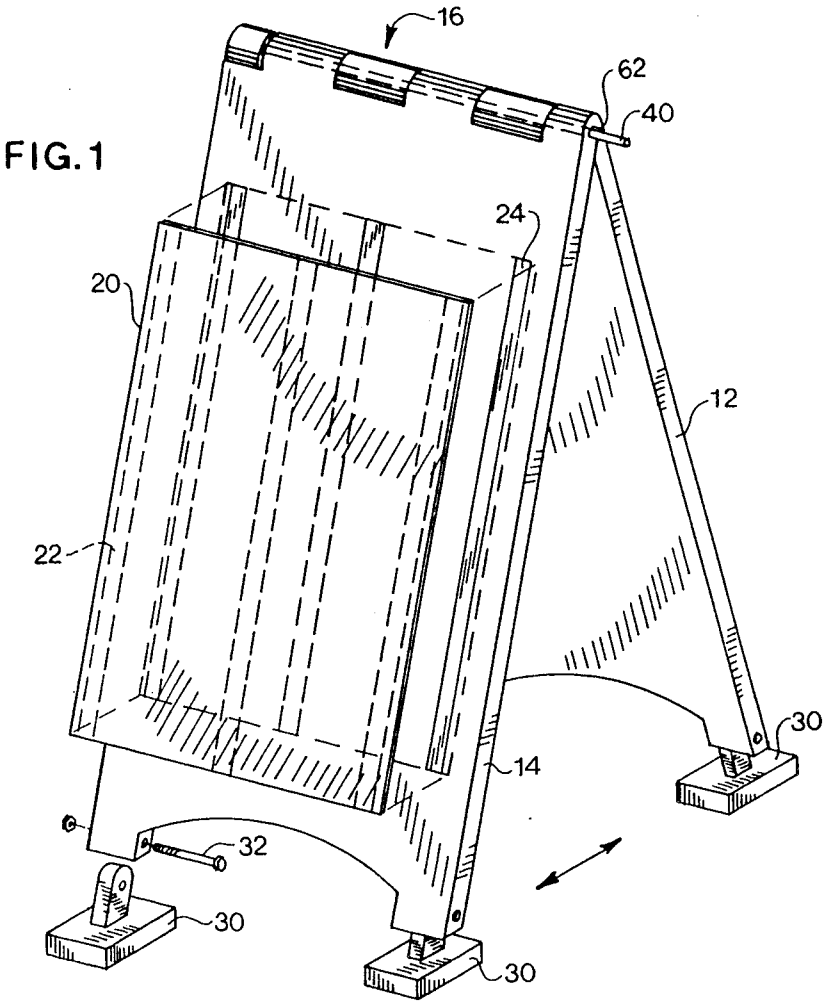
FIG. 1 is a perspective view of the panel sign of the present invention showing the replaceable signage.

Turning first to FIG. 1, there is shown a panel sign in accordance with the present invention including two panels 12 and 14 hinged at one end by hinge means 16 to allow the lower ends of the panels to spread. The face of these panels carries selectively removable signage 20 having strips of adhering material 22 on the back thereof. The panels each carry a mating strip 24 of like material to provide for selective attachment of the signage. These strips of adhesive material may be pressure sensitive adhesive chemicals, magnetically adhesive strips, or hook/loop attachment strips, such as is commercially known and sold under the trademark "Velcro".

Figure 3:
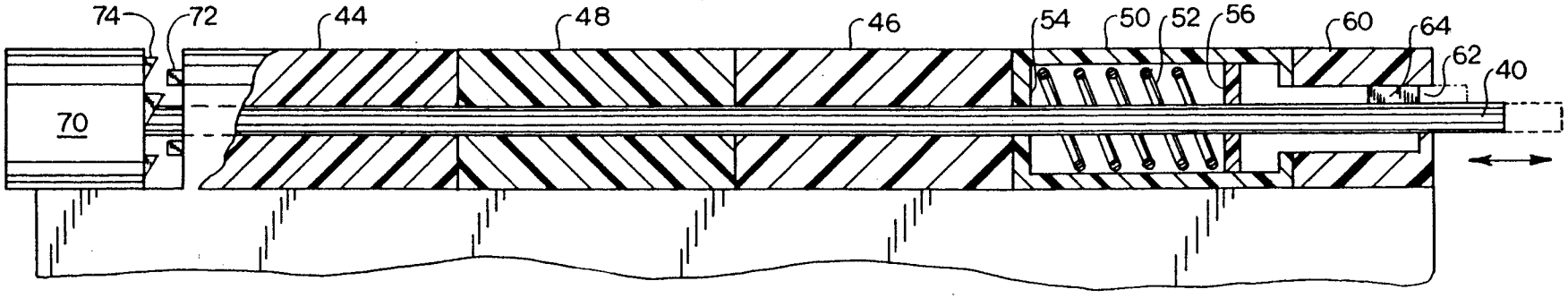
FIG. 3 is a front cutaway view of the ratchet mechanism of the panel sign apparatus.
Figure 6:
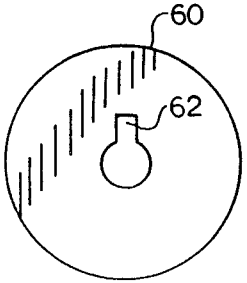
FIG. 6 is an end view of the keyhole engagement device for the axial member.
Figure 5:
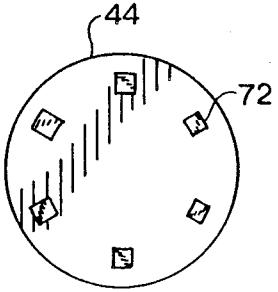
FIG. 5 is an end view of the locking protrusions affixed to the hinge.
Figure 4:
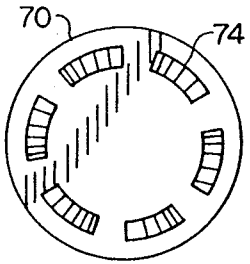
FIG. 4 is an end view of the locking member portion of the ratchet mechanism showing the ratcheting protrusions.
Figure 2:
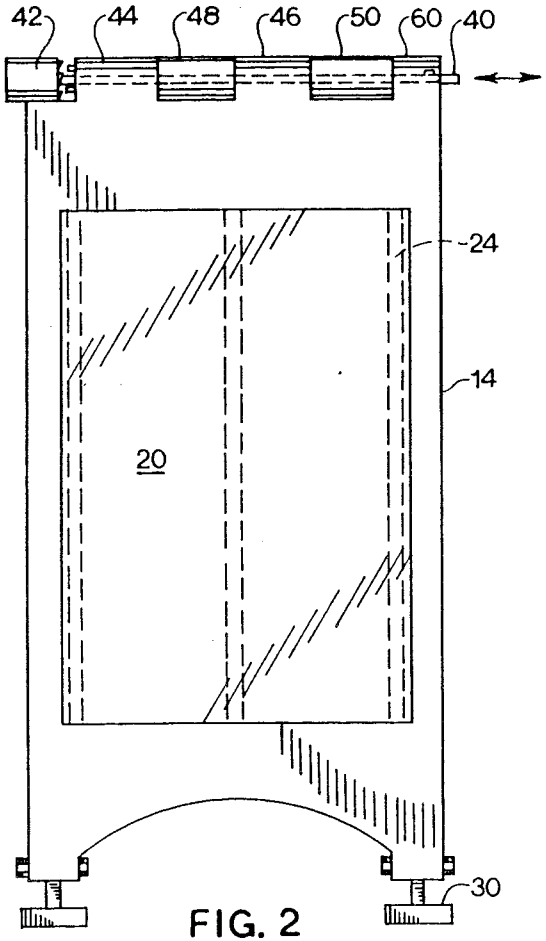
FIG. 2 is a frontal view of the apparatus of FIG. 1.

At the lower end of these panels there is provided swivel foot attachments 30 arranged to pivot on a pin member, such as a bolt 32 positioned through a hole therefore in the protruding feet of the panel members. In a further feature, these foot members may carry magnetic material to allow the sign to adhere to metal, such as a vehicle. At the upper hinged portion of the panel sign there is provided a releasable ratchet mechanism within the hinge (FIG. 3). During operation, the lower end of the panels are separated to the desired position and the hinge ratchets to that point, whereupon it locks. To close the panels of the sign one against the other, there is provided a protruding axial member 40 forming a pushbutton to release the ratchet and allow closure of the panel sign. Pressure on the release button 40 shifts the axial member to force the end lock 42 out of engagement with the hinge.

For a clearer understanding of the hinge ratchet and lock mechanism, reference will now be made to FIG. 3. Particularly, the front panel extends upwardly and forms one part of the hinge, with integral tubular members 44 and 46 having an axial passageway in the center portions thereof. Similarly, the rear panel member presents tubular members 48 and 50. The end most tubular member 50 has an enlarged cavity therein for a coil spring member 52 positioned to urge the axial member and pushbutton outwardly. This coil spring seats against the cavity wall 54 at one end of the cavity and pushes against the washer or plate member 56 at the other end. This washer or plate member is affixed to the axial member 40 to thereby urge that axial member outwardly. Means to rotatively secure the axial member to the tubular hinge member 50 is provided by tubular member 60. This mechanism includes an axial opening in the center thereof having a keyhole slot 62 arranged slideably to accept a key tab 64 protruding from the axial member. Once assembled, the tubular member 60 is secured to the rear panel hinge member 50, thereby forcing the engaged axial member 40 to rotate with the hinge members of the rear panel. This keyhole maintains engagement during a limited degree of travel of the axial member, but when the tab is pushed passed the keyhole it may be temporarily trapped within the tubular member 60 to allow free hinging movement without pressure on the push button.

During a hinging motion, the hinge members of the front and rear panels will rotate in opposite directions. End locking member 70 is affixed to the axial member 40 and constrained to rotate therewith. Consequently locking member 70 will rotate in a counter-direction to the hinge member 44 formed with the front panel. Protruding from the hinge member 44 are locking projections 72. Protruding from the locking member 70 are ramp-like projection 74 arranged to engage locking projections 72 when rotated in one direction but to slide past the projections 72 when rotated in the opposite direction.

When the coil spring is extended and the axial member 40 is extended, the locking member 70 will shift to engage the ratchet protrusions 74 and 72. When so engaged, the panel members may be opened to any desired position and the locking member will secure the panels in that position until released. Moreover, shifting of the axial member to force separation of the locking member 70 from the tubular hinge member 44 will release the locking projections and allow the panel sign to collapse the panels together.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A floor sign comprising:

two panels hinged together at their upper ends to allow selective spreading of the lower ends of the panels, said panels having tubular portions at the hinge thereof, wherein said hinge is formed by connecting said tubular portions with a common axial member; and selective locking means slideably operative along the axis of said hinge and arranged to engage one side of said hinge and to selectively engage the other side of said hinge;

wherein said selective locking means comprises an axial member arranged to slide within said hinge, said axial member being restrained to rotate with only one side of said hinge, and further comprises ratchet means affixed to said axial member and arranged to engage the opposite side of said hinge; and wherein said rotational restraint of said axial member comprises a keyhole affixed to said hinge, and a protruding tab integral with said axial member arranged to slideably travel within said key hole.

2. The floor sign of claim 1 wherein said ratchet means comprises protrusions integral with one side of said hinge and protrusions integral with a locking member affixed to said axial member, wherein said protrusions lock said respective hinge and locking members one against the other to prevent rotation only in one direction, and further comprising means to urge said protrusions into engagement.

3. The floor sign apparatus of claim 1 further comprising magnetic foot members pivotally attached at the lower ends of said panels.

4. The floor sign of claim 1 wherein said panels are provided with means to adhere selected signage to the face thereof.

5. The floor sign of claim 4 wherein said means to adhere signage comprises magnetically adhesive means.

6. The floor sign of claim 4 wherein said means to adhere signage comprises hook and loop fastener means.

* * * * *